United States Patent [19]

Totino et al.

[11] 4,185,574

[45] Jan. 29, 1980

[54] TRACK GUIDED NEEDLE THREADER SYSTEM

[75] Inventors: Peter J. Totino, New Bergen; Robert Sedlatschek, Bridgewater, both of N.J.

[73] Assignee: The Singer Company, New York, N.Y.

[21] Appl. No.: 950,497

[22] Filed: Oct. 11, 1978

[51] Int. Cl.[2] ..... D05B 87/02

[52] U.S. Cl. ..... 112/225

[58] Field of Search ..... 112/225, 242, 224, 226, 112/158 E; 223/99

[56] References Cited

U.S. PATENT DOCUMENTS

| | | | |
|---|---|---|---|
| 698,414 | 4/1902 | Schaefer | 112/225 |
| 1,230,378 | 6/1917 | Burns | 112/225 |
| 2,544,577 | 3/1951 | Weber | 112/225 |
| 2,767,671 | 10/1956 | Shapiro | 112/225 |
| 3,002,476 | 10/1961 | Capelli | 112/225 |
| 3,485,194 | 12/1969 | Eguchi | 112/225 |
| 3,517,631 | 6/1970 | Weber | 112/225 |

FOREIGN PATENT DOCUMENTS 14529 8/1903 Austria .

*Primary Examiner*—Werner H. Schroeder
*Assistant Examiner*—Andrew M. Falik
*Attorney, Agent, or Firm*—Robert E. Smith; Edward L. Bell; Edward P. Schmidt

[57] ABSTRACT

A needle threader assist which uses a needle threader having a conical opening for guiding thread through a bore thereof into the eye of a sewing needle supported by a sewing machine. Support means are provided with the needle threader which when moved to an operative position, unlatches the needle bar from its drive means and elevates it to an uppermost position and simultaneously moves the needle bar to a predetermined lateral position, permitting the bore of the needle threader to be readily located axially with the eye of the sewing needle.

5 Claims, 4 Drawing Figures

TRACK GUIDED NEEDLE THREADER SYSTEM

BACKGROUND OF THE INVENTION

This invention is in the field of sewing machines, more specifically, it is concerned with the means for threading the sewing needle of an electronically controlled family zig-zag sewing machine.

Sewing machine needle threaders are known in the prior art. There is, for example, U.S. Pat. No. 698,414 issued on Apr. 22, 1902 to Schaefer which disclosed a thread guide having a conical opening leading to the eye of a sewing needle, with a pair of thread gripping fingers behind the eye to grasp thread guided therethrough.

There is also U.S. Pat. No. 2,544,577 issued on Mar. 6, 1951 to Weber, which discloses a needle threader mounted on a bracket which follows a track formed in and fastened to the sewing machine head in order to position the threader adjacent the eye of the sewing needle. Means are provided in this device, in the environment of a straight stitch sewing machine, to position the threader adjacent the eye of the sewing needle by having a portion of the threader impinge upon the driving stud of the needle bar.

In order to have a needle threader operative with a zig-zag sewing machine, it is normally necessary to locate the needle bar in a specific left, center or right needle position, and to rotate the hand wheel so that the sewing needle is located in a specific position such as top dead center.

There is also known in the prior art electronically controlled sewing machines wherein the needle bar may be positioned laterally by electric drive means under the control of electronic circuitry. Such a sewing machine is shown in the U.S. Pat. No. 3,984,745 issued on Oct. 5, 1976 to Minalga. The use of electronic control for the sewing instrumentalities of a sewing machine represents a new step forward in sewing machine design in as much as the sewing capabilities of such a sewing machine may be greatly enlarged and operation thereof may be simplified by elimination of some of the previously required controls for mechanically controlled sewing machines.

What is required is some means to simplify the use of a needle threader system with such an electronically controlled sewing machine, thereby making it readily available for the use of an operator.

SUMMARY OF THE INVENTION

The above requirement is met in the invention wherein a needle threader system is guided by a track into cooperative relationship with a sewing needle, while simultaneously disengaging a latch release member from a driving stud and actuating a switch which signals a Large Scale Intergrated Circuit (LSI) to center the needle bar and actuate a solenoid to maintain the needle bar in a released position while the needle threader system is in an operative position. The needle threader system includes a bracket supported by the sewing machine frame having tracks thereon which are engaged by pins carried by a needle threader. Thus, as the needle threader is lowered to an operative position, it is supported and oriented by the tracks through the pins to place a conical opening leading to a bore on the lower end of the needle threader in the proper position with respect to the eye of the sewing needle carried by the needle bar. A pair of protuberances on the needle threader are used to properly position the needle threader with respect to the sewing needle so that the bore and the conical opening are axially located with respect to the eye of the sewing needle. When the needle eye is threaded by passing thread through the conical opening to the eye of the needle, a thread gripper behind the eye of the needle may be manipulated to catch the thread and upon elevation of the needle threader will draw a supply of thread through the eye of the needle. Thread may be removed from the conical opening by way of an axial slot provided for this purpose.

DESCRIPTION OF THE DRAWINGS

The subject matter which is regarded as the invention is particularly pointed out and distinctly claimed in the concluding portion of this specification. The invention itself, however, both as to its organization and method of operation thereof may best be understood by reference to the following descriptions taken in connection with the accompanying drawings in which:

Referring to FIG. 1, there is shown the head end portion of a sewing machine 10 including a portion of the bracket arm 11 terminating in a sewing head 12. In the usual fashion, the sewing head 12 overhangs a bed portion 14 of the sewing machine 10.

Figure 1:
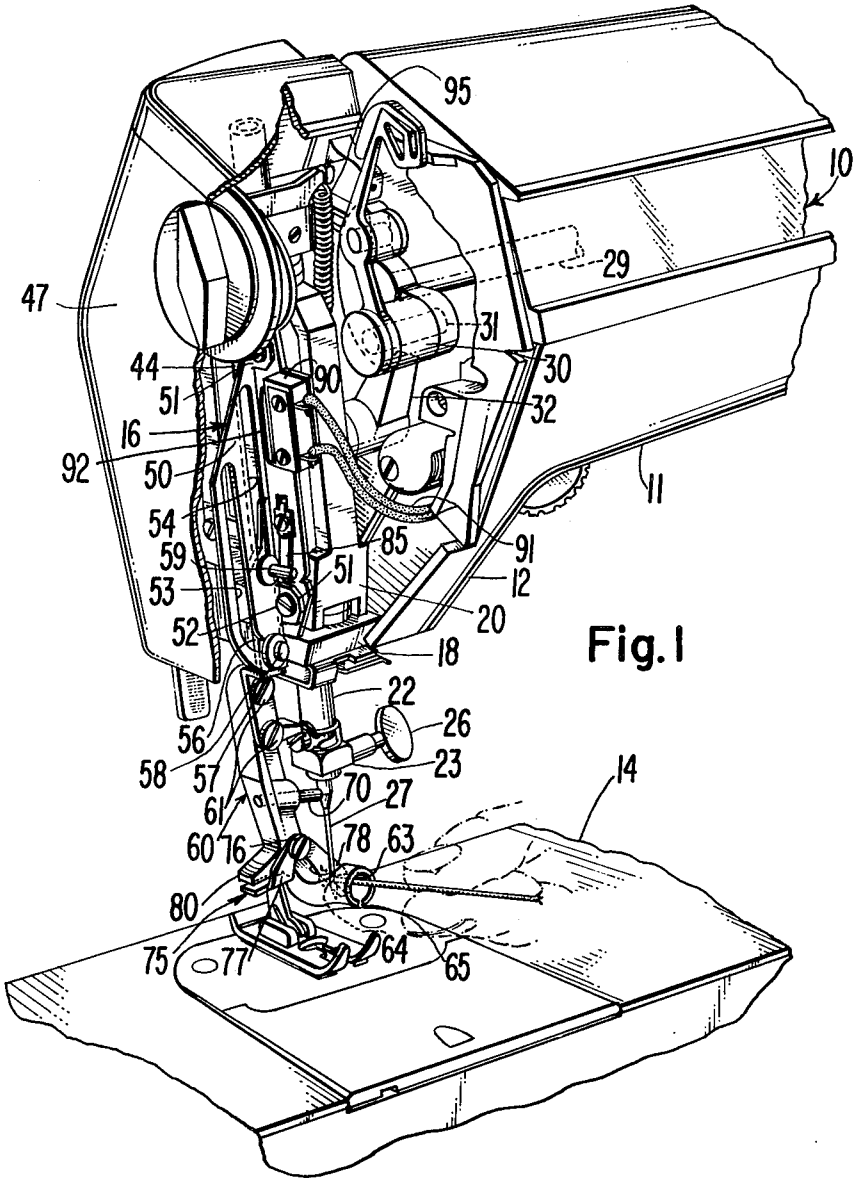
FIG. 1 is a perspective view of the sewing head portion of a sewing machine partially broken away to show the invention.

Supported in the sewing head portion 12 is a needle bar gate arrangement 16, similar in large measure to that disclosed in the U.S. Pat. No. 3,872,809 issued on Mar. 25, 1975 to Adams et al, which is assigned to the same Assignee as the instant invention and is hereby incorporated by reference herein. The needle bar gate arrangement 16 includes a support bracket 18 which is fastened to the frame of the sewing machine 10 by screws 19, which support bracket encircles and pivotally supports a needle bar gate 20. The needle bar gate 20 supports for endwise reciprocation a needle bar 22, at one end of which there is carried a needle bar clamp 23 which is attached to the needle bar by means of screw 24. A thumb screw 26 is carried by the needle bar clamp 23 so as to retain affixed to the needle bar 22 a sewing needle 27. The needle bar 22 and sewing needle 27 affixed thereto is made to undergo endwise reciprocation by means of horizontal arm shaft 29 having a crank 30 connected by a pin 31 to a connecting rod 32, which connecting rod is also connected to a driving stud 34 slidably carried by the needle bar 22 in a manner well known in the sewing machine art. (See also FIGS. 3 and 4). The driving stud 34 may be engaged, in an operative position, by a latch release member 36 pivotally carried on a shouldered screw 38 affixed to a block portion 40 which itself affixed to the needle bar 22 by means of a screw 41 (See FIGS. 2 and 4). Thus, the latch release member 36 pivotally carried by the block portion 40 on the shouldered screw 38 may engage with cheek pieces 35 of the driving stud 34 in order to retain the driving stud in intimate contact with the block portion. Motion of the driving stud 34 is thereby transmitted to the needle bar 22.

The needle bar 22 is also adapted to undergo lateral oscillation in the formation of zig-zag stitches. In order to obtain more information on the operation of the needle bar gate arrangement, the reader is referred to the U.S. Pat. No. 3,782,311 issued on Jan. 1, 1974 to Adams et al, which is hereby incorporated by reference herein. From that patent, greater details may also be obtained on the latching mechanism used to disconnect the needle bar from the endwise reciprocatory means. However, it is to be understood that the instant invention is more readily implemented by utilizing a solenoid device to disengage the needle bar from its driving means as being more compatible with the controls of an electronically controlled sewing machine. In that same regard, even though the U.S. Pat. No. 3,782,311 of Adams et al shows a cam device to initiate lateral oscillation of the needle bar, it is more preferable that an electronic control arrangement be used such as is disclosed in U.S. Pat. No. 3,984,745 issued on Oct. 5, 1976 to Minalga, which is hereby incorporated by reference herein.

Figure 2:
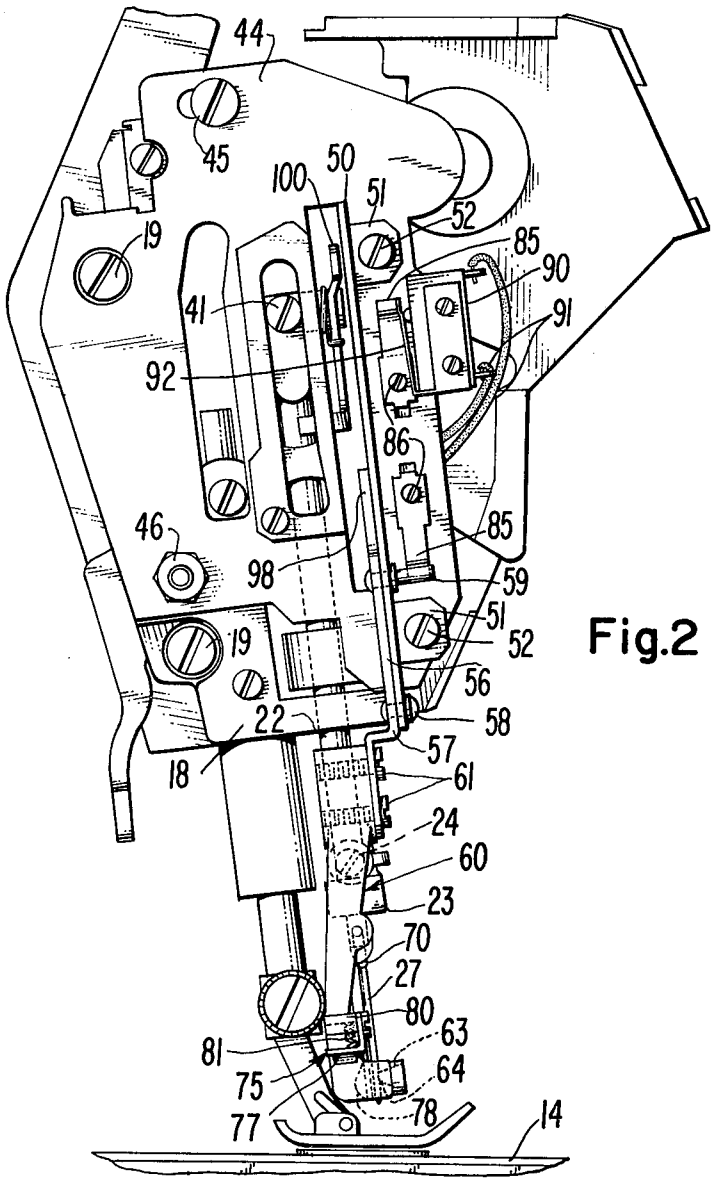
FIG. 2 is a side elevational view of the sewing head portion with parts removed to show details of the invention.

Referring now to FIG. 2, there is shown a side elevational view of the sewing machine 10 with the cover 47 removed therefrom. With the cover 47 thus removed, there is visible the plate 44 affixed to the support bracket 18 by means of screw 45 and nut 46. A sheet metal cam 50 is fastened to the plate 44 by means of screws 52 extending through ears 51 of the sheet metal cam. The sheet metal cam 50 is fashioned with cam tracks 53 and 54 (See FIGS. 1 and 3). The sheet metal cam 50 extends parallel to the axis of the needle bar 22. A slide 56 is arranged to slide along the sheet metal cam 50 and is slidably connected thereto by a rivet 58 extending through the slide and cam track 53 of the sheet metal cam, and by a rivet 59 extending through the slot and through the cam track 54 and for a distance beyond the sheet metal cam. The lower end of the slide 56 is offset as at 57, and a needle threader 60 is attached to the offset portion by screws 61 extending through the slide into tapped holes in the needle threader. In this fashion, up and down motion of the needle threader 60 is effected by the slide 56 while the rivets 58 and 59 extending through the cam tracks 53,54 provide a slight rotational motion to the needle threader owing to the curve in the cam track 53.

The needle threader 60 may be made preferably of a synthetic resin and is fashioned at its lower extremity with a conical opening 63 terminating in a bore 64 to allow passage of thread. A slot 65 extends from the extremity of the needle threader through the conical opening 63 to the bore 64 to provide for removal of thread from the needle threader after the sewing needle 27 has been threaded. The needle threader 60 is further formed with an abutment 66 designed to impinge upon the screw 24 affixing the needle bar clamp 23 to the needle bar 22. The abutment 66 is spaced from the bore 64 at the extremity of the needle threader 60, a distance equal to the dimension from the eye of the sewing needle to the top of the screw 24 when the sewing needle 27 is properly seated in the needle bar clamp 23 and fastened thereto by the thumb screw 26. Thus, the abutment 66 serves to locate the conical opening 63 and bore 64 at the lower end of the needle threader 60 in a vertical direction with the eye of the sewing needle 27.

Below the abutment 66 of the needle threader 60, there is carried a stop member 70 which is threadedly connected to the needle threader so as to provide for selective extension therefrom. The stop member 70 limits the inward motion of the needle threader 60 so as to permit adjustment in the horizontal plane of the location of the bore 64 in order to obtain a matchup of the bore with the eye of the sewing needle 27, the shank of which the stop member impinges upon.

There is also located at the extremity of the needle threader 60 a gripper member 75 attached thereto by shouldered screw 76. The gripper member 75 is fashioned with a handle 77 and a blade 78. A complimentary abutment 80 on the needle threader 60 adjacent the handle 77 of the gripper member 75 provides a convenient surface to permit gripping of the abutment and handle of the gripper member between a thumb and forefinger. A spring 81 between the abutment 80 and the handle 77 biases the gripper member 75 in a counterclockwise direction.

In operation, when thread is fed through the conical opening 63 at the extremity of the needle threader 60 and through the bore 64, it will, if properly adjusted, extend through the eye of the sewing needle 27 and the thread end will lay against the lower portion of the needle threader. Pressing of the abutment 80 and handle 77 together will cause the blade 78 to impinge upon the thread extending through the needle eye and, upon elevation of the needle threader 60, will draw additional thread supply through the needle eye.

Referring once again to FIG. 2, there is shown supported on plate 44 a pair of leaf springs 85 which are affixed to the plate by screws 86. As shown in FIG. 2, these leaf springs 85 are formed with curved ends 87 (See FIG. 3) which coact with the extension to the rivet 59 to retain the slide 56 and needle threader 60 in a selected raised or lowered position.

Figure 4:
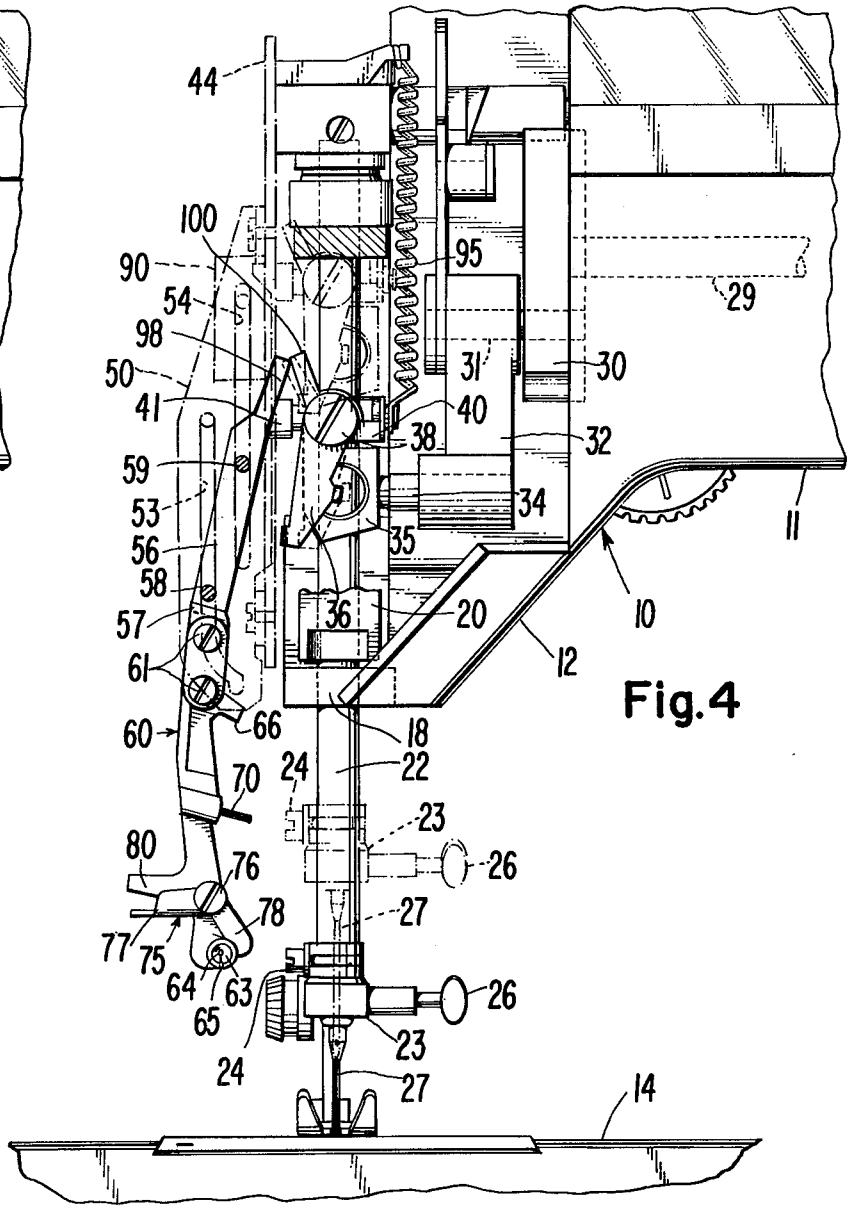
Figure 3:
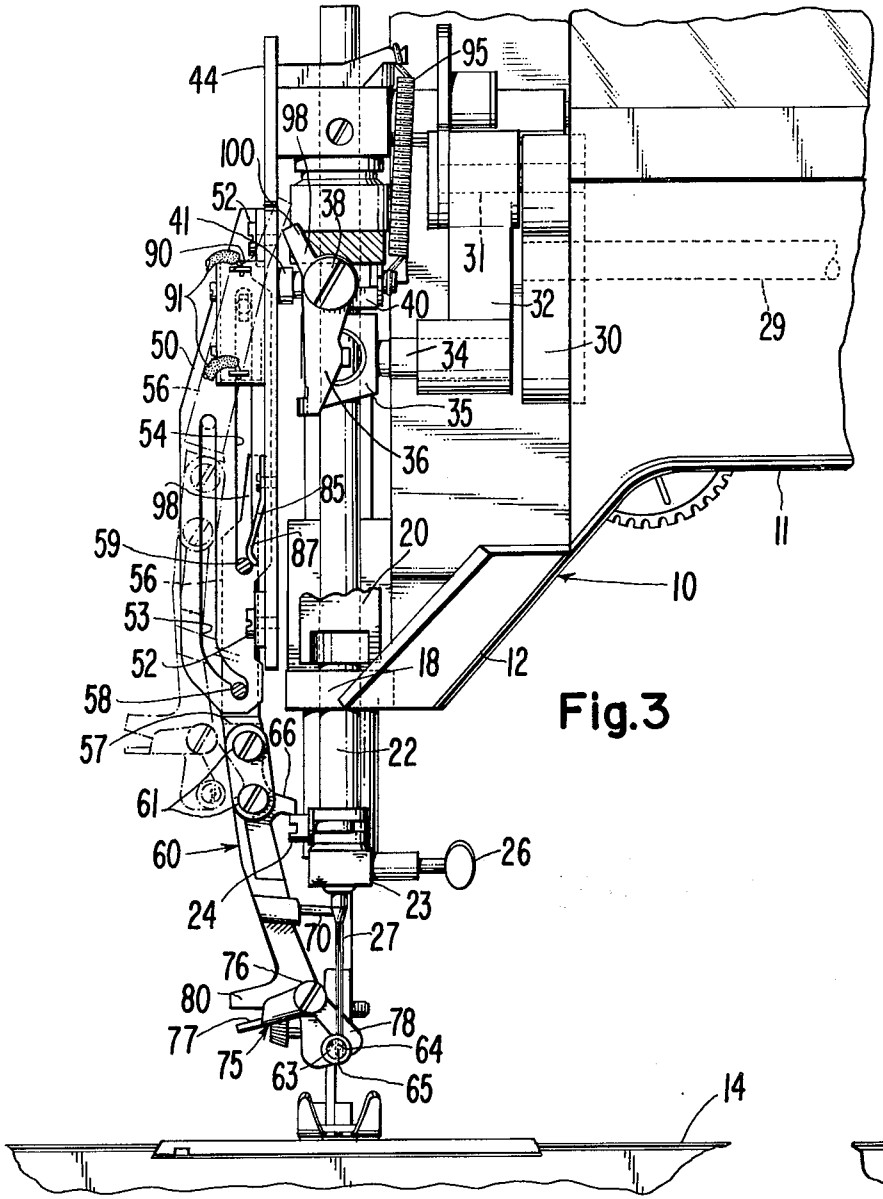
FIG. 3 is a front elevational view of the sewing head portion of the sewing machine shown in FIG. 1; and, FIG. 4 is a view similar to FIG. 3 showing, however, the needle threader system of the invention in a partially retracted position.

Also supported on the plate 44 is a microswitch 90, the microswitch having leads 91 for connection to electronic circuitry as will be explained below. The microswitch 90 is arranged such that when the needle threader is the raised position, the extended end of the rivet 59 will impinge upon a member 92 of the microswitch 90 in order to actuate the microswitch. Thus, as the needle threader 60 is lowered to an operative position, the extended end of the rivet 59 will release the member 92 and actuate the microswitch 90. Suitable circuitry may be provided very similar to that shown in the U.S. Pat. No. 3,987,739 issued on Oct. 26, 1976 to Wurst et al, which is hereby incorporated by reference herein. In that patent, there is disclosed a means to inhibit the sewing machine operation in order to suspend needle reciprocation, needle jogging and work feed motion. Thus, whenever it is desired to thread the sewing needle 27, the needle threader 60 is lowered to an operative position and concurrently therewith, the needle bar 22 is disconnected from the sewing machine driving means and the needle bar is placed in a center needle position. Whenever the needle bar 22 is disconnected from the sewing machine drive means, an extension spring 95 will draw the needle bar 22 to an elevated position as is shown in FIG. 3 and in phantom in FIG. 4. In FIG. 3, the needle threader 60 is shown in a position wherein the needle threader 60 may be used to thread the sewing needle 27 and, in phantom, in an elevated position. In FIG. 4, there is shown an additional safety feature which may be incorporated in the needle threader 60 and slide 56 thereof. The slide 56 is formed with an extension 98 at its upper extremity. The latch release member 36 is also fashioned with an extended abutment 100 which may be struck by the extension 98 as the needle threader 60 is lowered to an operative position. This interference will cause the latch release member 36 to pivot in a clockwise direction and release the needle bar 22 from engagement with the sewing machine driving means. Thereby, the needle bar 22 is drawn to the position shown in phantom in FIG. 4 by the extension spring 95 to a position where continued lowering of the needle threader 60 will rotate the conical opening 63 directly in front of the eye of the sewing needle 27. Referring to FIG. 3, it may be seen that when the needle threader 60 and slide 56 are in the stored position, the extension 98 to the slide will not cause rotation of the latch release member 36 even when the needle bar 22 is in its uppermost location.

Thus has been disclosed a system for placing the needle bar 22 in a specific lateral and elevated position automatically when the needle threader 60 is lowered to an operative position. The needle threader 60 is formed with an abutment 66 and a stop member 70 which impinge, respectively, upon a point on the needle bar 22 having a specific relation to the eye of the sewing needle 27 and upon the sewing needle itself to limit the lateral motion of the conical opening 63 at the extremity of the needle threader. By proper design and suitable adjustment of the stop member 70, the needle threader 60 may have the conical opening 63 located directly in front of the eye of the sewing needle 27.

Having thus set forth the nature of the invention, what is sought to be claimed is:

1. In a sewing machine having a frame, a needle bar arranged in said frame for endwise reciprocatory motion, and a sewing needle removably attached to the end of said needle bar, said needle having a thread bearing eye, a needle threader assist comprising:

a bracket shiftably mounted on said frame for shifting between a stored position and an operative position;

a member supported by said bracket, said member having a terminus thereof formed with a conical opening for guiding thread to said needle eye;

a thread gripper pivotably supported on said terminus of said member spaced behind said conical opening to accommodate said sewing needle therebetween, said gripper having a blade portion extending adjacent said conical opening away from said terminus, whereby thread passing through said conical opening in said eye of said needle extends between said terminus and said blade and may be gripped by said gripper;

automatic means operative upon shifting of said bracket from said stored position for moving said needle to a position conducive for the threading of said needle eye; and, positioning means acting on said bracket for aligning said conical opening with said needle eye.

2. A needle threader assist as set forth in claim 1 wherein said positioning means includes a projection on said member for engaging an abutment on said needle bar, the distance between said projection and said conical opening being substantially the same as the distance between said abutment and said needle eye.

3. A threader assist as set forth in claim 2 wherein said positioning means further includes a track in which said bracket is mounted for guiding said conical opening to the position which said needle eye would occupy when said needle is at said position conducive for threading of said needle eye.

4. A needle threader assist as set forth in claim 1 wherein said sewing machine includes a needle bar gate for supporting said needle bar in a selected lateral position and means for urging said needle bar to said selected lateral position, and wherein said automatic needle moving means includes an electrical switch for initiating movement of said needle bar to the uppermost position in the reciprocating cycle thereof, for arresting further movement of said needle bar, and for moving said needle bar to a selected lateral position, whereby said needle is in a position conducive for threading of said needle eye.

5. A needle threader assist as set forth in claim 4 wherein said electrical switch is actuated by the shifting of said bracket out of said stored position.

* * * * *